US007699246B2

(12) United States Patent
Malamutmann

(10) Patent No.: US 7,699,246 B2
(45) Date of Patent: Apr. 20, 2010

(54) SUPPLY SYSTEM

(75) Inventor: Eugen Malamutmann, Mengeder Str. 512, 44359 Dortmund (DE)

(73) Assignees: Eugen Malamutmann, Dortmund (DE); Viktor Malamutmann, Dortmund (DE)

( * ) Notice: Subject to any disclaimer, the term of this patent is extended or adjusted under 35 U.S.C. 154(b) by 0 days.

(21) Appl. No.: 11/791,357

(22) PCT Filed: Nov. 22, 2005

(86) PCT No.: PCT/EP2005/012495

§ 371 (c)(1),
(2), (4) Date: Mar. 19, 2008

(87) PCT Pub. No.: WO2006/056409

PCT Pub. Date: Jun. 1, 2006

(65) Prior Publication Data

US 2008/0191052 A1 Aug. 14, 2008

(30) Foreign Application Priority Data

Nov. 23, 2004 (DE) ..... 10 2004 056 455

(51) Int. Cl.

| | |
|---|---|
| ***A62C 5/00*** | (2006.01) |
| ***A62C 31/00*** | (2006.01) |
| ***B05B 7/04*** | (2006.01) |
| ***F23D 11/36*** | (2006.01) |
| ***F23D 11/40*** | (2006.01) |
| ***F23D 14/62*** | (2006.01) |
| *A62C 5/02* | (2006.01) |

(52) U.S. Cl. ..... 239/398; 239/9; 239/427; 239/427.5

(58) Field of Classification Search ..... 239/398, 239/400, 406, 418, 419.3, 423, 427
See application file for complete search history.

(56) References Cited

U.S. PATENT DOCUMENTS

| | | | | |
|---|---|---|---|---|
| 3,531,050 | A * | 9/1970 | Abraham et al. | 239/427.3 |
| 3,881,529 | A * | 5/1975 | Mannara | 141/100 |
| 4,014,369 | A * | 3/1977 | Kobres, Jr. | 138/112 |
| 5,044,559 | A * | 9/1991 | Russell et al. | 239/406 |
| 5,327,945 | A * | 7/1994 | Simpson et al. | 141/59 |

FOREIGN PATENT DOCUMENTS

| | | |
|---|---|---|
| WO | WO-01/76764 | 10/2001 |
| WO | WO-03/095097 | 11/2003 |
| WO | WO-2004/008905 | 1/2004 |

* cited by examiner

*Primary Examiner*—Len Tran
*Assistant Examiner*—James S Hogan
(74) *Attorney, Agent, or Firm*—K&L Gates LLP

(57) ABSTRACT

In a supply system fluids are supplied separated from each other to a delivery head through chambers (1, 3, 5) formed in a single supply line. In the delivery head a fluid mixture is produced and delivered to the outside in the form of mist. It is possible to deliver different fluids or fluid mixtures within individual cycles by a control.

14 Claims, 18 Drawing Sheets

PF – fluid pressure

PG – gas pressure

VAC – vacuum

SUPPLY SYSTEM

This application is a U.S. national stage application of International Application No. PCT/EP2005/012495, filed Nov. 22, 2005, having an International Publication Number of WO 2006/056409 A2 and an International Publication Date of Jun. 1, 2006, which claims priority from German Patent Application No. 10 2004 056 455.8, filed Nov. 23, 2004.

The invention relates to a supply system for fluids which is especially suited for delivering a fluid mixture to a surface and a method of fluid delivery.

There are plural cases in which a delivery or a spraying of a fluid mixture onto a body, a surface, into a chamber etc. is necessary to achieve a desired effect. In particular, the fields of painting technique, the medical treatment of wounds by various treatment mediums, the field of air-conditioning, of laboratory technology for chemistry and/or biology, of purification technique, technology used in fire fighting or in agriculture are mentioned by way of example.

From the state of the art systems are known comprising a plurality of tubes through which various fluids are supplied to be finally mixed in a mixing device and delivered to the outside.

In EP 0 673 683, for instance, an air and liquid tube system for a hand spray gun is disclosed. In this system a fluid tube and an air tube are connected to the handle of a paint spray gun.

A supply device for fluids according to the invention comprises in a supply line a first chamber for feeding a first fluid and a second chamber for feeding a second fluid. The chambers are formed by an axial division of the supply line and are located coaxially with respect to each other.

In particular, the cross-section of the first chamber is in the form of a circle, while the second chamber is a ring segment. It is preferred that the center of the circle is identical with the center of the ring segment.

According to an aspect of the invention, a third fluid or further fluids can be supplied through a third chamber or further chambers. In particular, it is also possible to provide one of the chambers for discharging a fluid opposite to the general feeding direction.

According to an aspect of the invention, an end of the supply line can be provided with a connecting member. The connecting member is made to fit on the supply line and seals the interior thereof against the environment in a fluid-tight manner. Moreover, the connecting member includes outer pipe nozzles and inner coupling members. A respective pipe nozzle is associated with a coupling member and is provided with a port passing through both components. The coupling members are designed in accordance with the chambers and are introduced into the same so that the interior of the chamber is sealed against the other chambers in a fluid-tight manner. Through the ports the respective fluids are introduced from outside into the chambers of the supply line and/or discharged.

It is likewise possible to design at least one of the pipe nozzles to be bent so that the central axis of the pipe nozzle is located at any angle to be selected with respect to the central axis of the connecting member. A preferred angle in this case is a right angle.

In accordance with another aspect of the invention, at the other end of the supply line a fluid delivery device can be provided. In particular, this fluid delivery device can be formed in that in an end portion of the supply line a plurality of injection ports are formed in the wall separating the first and second chambers in order to inject the pressurized fluid provided in the first chamber into the second chamber. A plurality of delivery ports is formed in the wall separating the second chamber from the outside in order to deliver the fluid mixture formed in the second chamber to the outside.

The geometry of the respective chambers can substantially correspond to the geometry of the chambers in the supply line.

Especially the number of the injection ports can correspond to the number of the delivery ports. Moreover, the injection ports are substantially designed to be radially aligned with the delivery ports.

The injection ports are preferably designed to be smaller than the delivery ports. But it is also possible to design the injection ports at least as large as or larger than the delivery ports.

According to an aspect, the central axis of the injection and delivery ports is not disposed at right angles with respect to the central axis of the supply/delivery device but it is inclined with respect thereto.

In accordance with an aspect of the invention, the injection and delivery ports may have a circular cross-section. As an alternative it is possible to design them to have different cross-sectional shapes or a combination of different cross-sectional shapes. Possible alternative cross-sectional shapes are e.g. a circle, an elliptical, oval or rectangular shape, a circle segment, a ring segment or a star.

According to a further aspect of the invention, a sealing member can be provided to close the end of the fluid delivery device opposed to the supply line in a fluid-tight manner so that a fluid or fluid mixture can exist solely through the delivery ports. The sealing member is especially such that a projection seals the second chamber in a fluid-tight manner against all other chambers, whereas a fluid connection of the other chambers is provided through a cavity in the sealing member. However, it is also possible to form the sealing member to include plural projections in such a way that all chambers are closed against one another in a fluid-tight manner and a connection only exists through the injection ports between the first chamber and the second chamber.

As an alternative to that, it is also possible to seal all chambers by means of the sealing member and to make the connection of the individual chambers via ports provided with valves.

In accordance with another aspect of the invention, the chambers of the fluid delivery device are flat-shaped, wherein the second chamber is adjacent to the first chamber in layers. In this case, separate connections are provided for each fluid.

For connecting individual supply devices or supply lines and fluid delivery devices connecting devices can be provided. The connecting device includes a connecting means provided with first and second pipe elements and a nozzle means provided with a third pipe element and a fourth pipe element. The first pipe element can be connected to the third pipe element and the second pipe element can be connected to the fourth pipe element in a fluid-tight manner.

Moreover, an inner edge portion and/or an outer edge portion of the pipe elements adapted to be connected in a fluid-tight manner can be tapered so as to provide the fluid-tight connection by plugging the respective pipe elements into each other.

According to an aspect, the first pipe element is arranged inside the second pipe element and the third pipe element is arranged inside the fourth pipe element.

At the connecting means the connecting device may include a sleeve element on the inside of which a plurality of projections are formed which, when the connection is made, are engaged in recesses formed on an outside of the pipe nozzle means so as to prevent an unintended separation of the connecting means and the pipe nozzle means.

Furthermore, the first and second pipe elements and/or the third and fourth pipe elements can be integrally formed, wherein a flange portion provided with openings connects the two pipe elements. In addition, connecting walls can be provided between pipe elements in the connecting means and between the pipe elements in the nozzle means so that the cross-sectional geometry corresponds to that of the supply line and/or the fluid delivery device.

In a method for fluid delivery to a surface according to the invention a first fluid is injected from the first chamber through the injection ports into a second fluid in the second chamber. The mixed fluids are then delivered to the outside through the delivery ports.

According to an aspect, a third fluid can flow through a cavity in the sealing member from the third chamber into the first chamber in order to be then injected into the second chamber instead of the first fluid or together with the first fluid.

This is especially made possible by a control unit controlling a pump which pressurizes the fluids in the individual chambers individually over predetermined periods of time so as to form the provided fluid mixture in the discharge device. It is possible to pressurize a plurality of fluids corresponding to the number of chambers or even to apply a vacuum to a part of the chambers in order to suck a fluid mixture to the pump opposed to the general feeding direction.

The control unit may preferably be in the form of a digital control unit. Different types of devices, such as, for instance, a vacuum pump, a roller pump, a pneumatic pump or a supply device working according to the ink jet principle can be combined with the control unit or can be integrated in the same.

Advantageously one or more of the afore-mentioned devices can be used in combination with each other, can be interconnected according to needs or can be alternatively used.

In order to check that the individual pressures are reached as predetermined, sensors may be provided for the individual chambers. Pressures detected by the sensors can be compared to the corresponding desired pressures by means of an electronic control and can be adapted in the case of deviation.

The fluids injected from the first chamber into the second chamber are especially liquids, whereas the second fluid in the second chamber is a gas. Therefore the fluid mixture delivered to the outside is provided as mist.

The supply system according to the invention can be employed in particular in the painting technique, in the medical treatment of wounds by various treatment mediums, in the field of air-conditioning, of laboratory technology for chemistry and/or biology, of purification technology, in methods used in fire fighting or in agriculture.

Hereinafter preferred embodiments of the invention will be illustrated in detail with respect to the Figures, in which:

FIG. 1(*a*) to 1(*i*) show cross-sectional views of different embodiments of a supply device according to the invention in an area of an end portion in the form of a delivery device;

Figure 14:
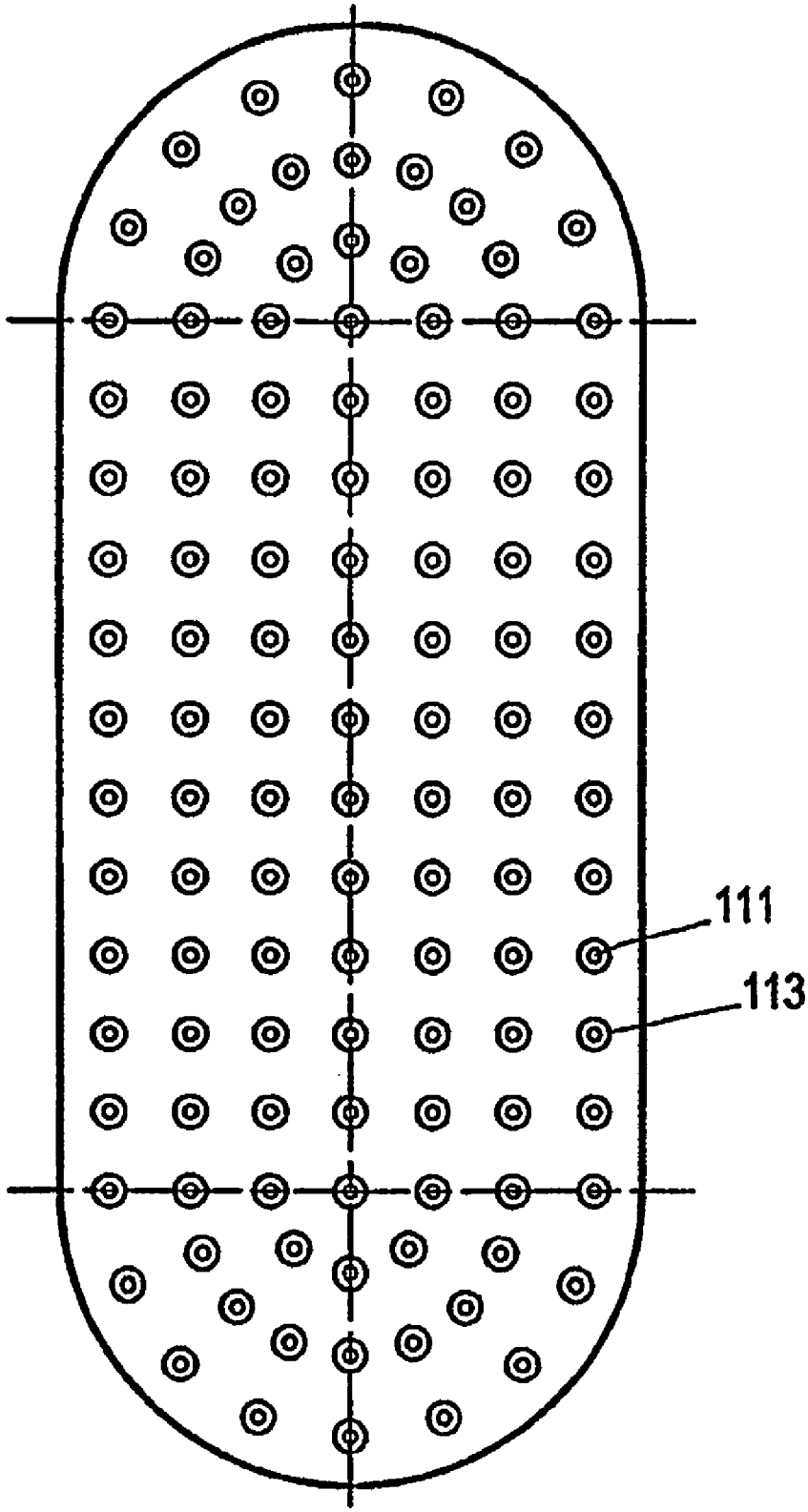
FIG. 14 is a top view of a delivery device according to an embodiment of the invention.
Figure 15:
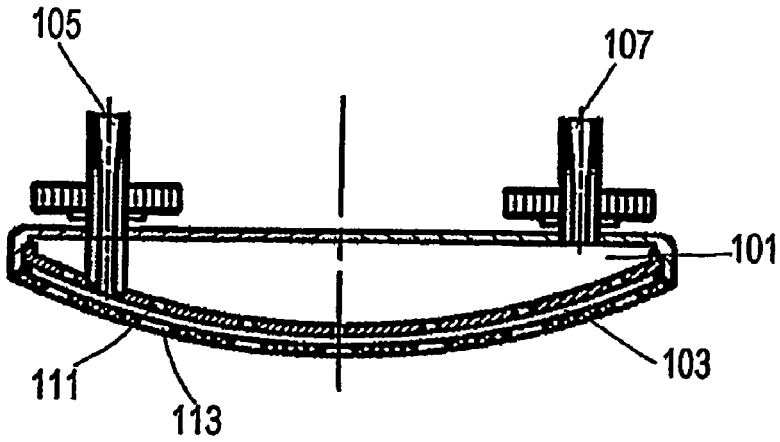
Figure 15:
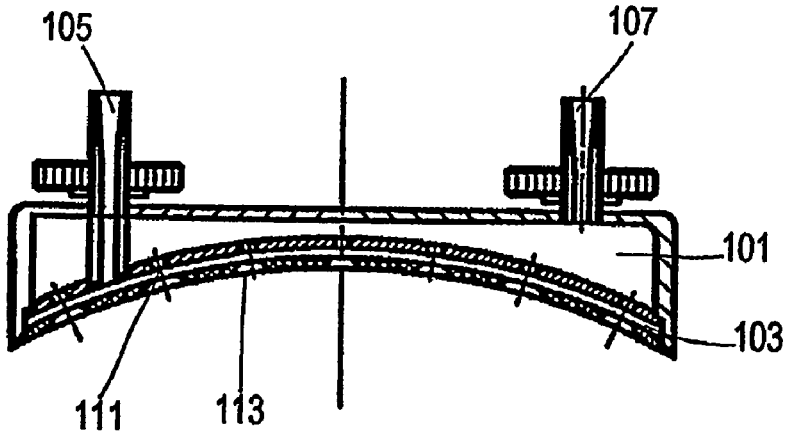
Figure 15:
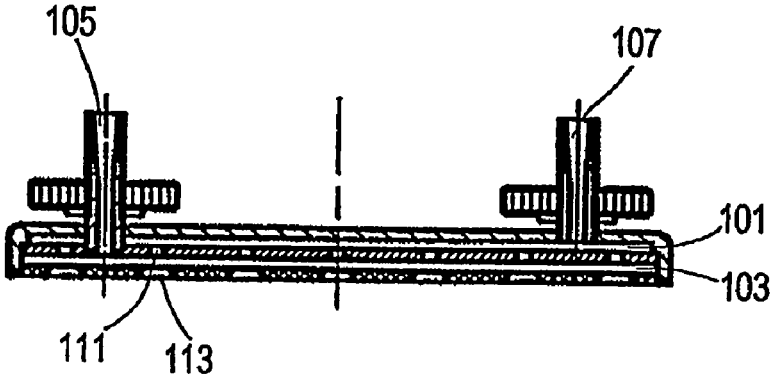
Figure 16:
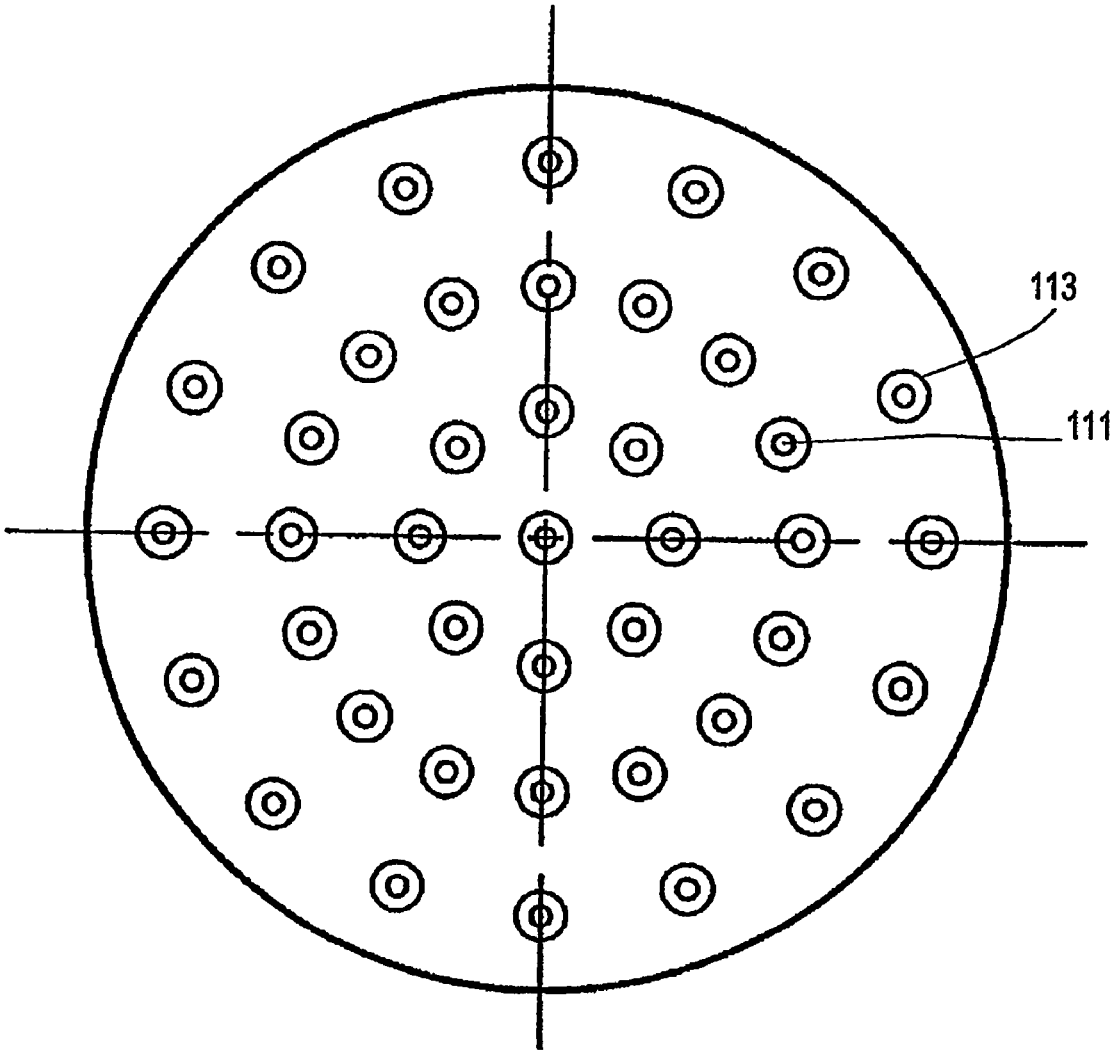
Figure 17:
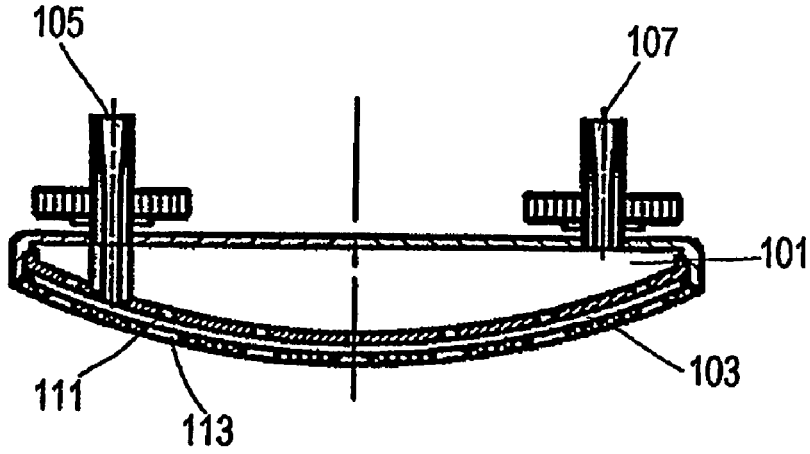
Figure 17:
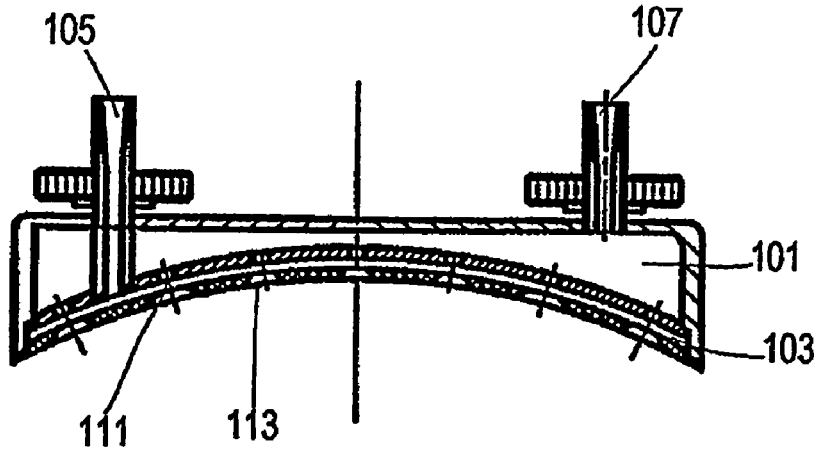
Figure 17:
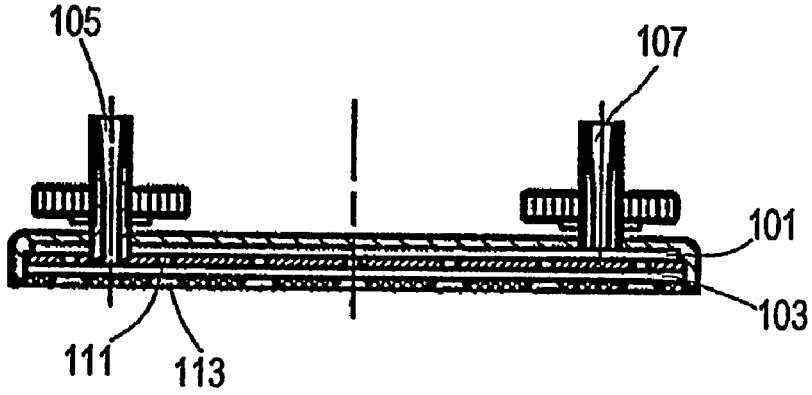
Figure 18:
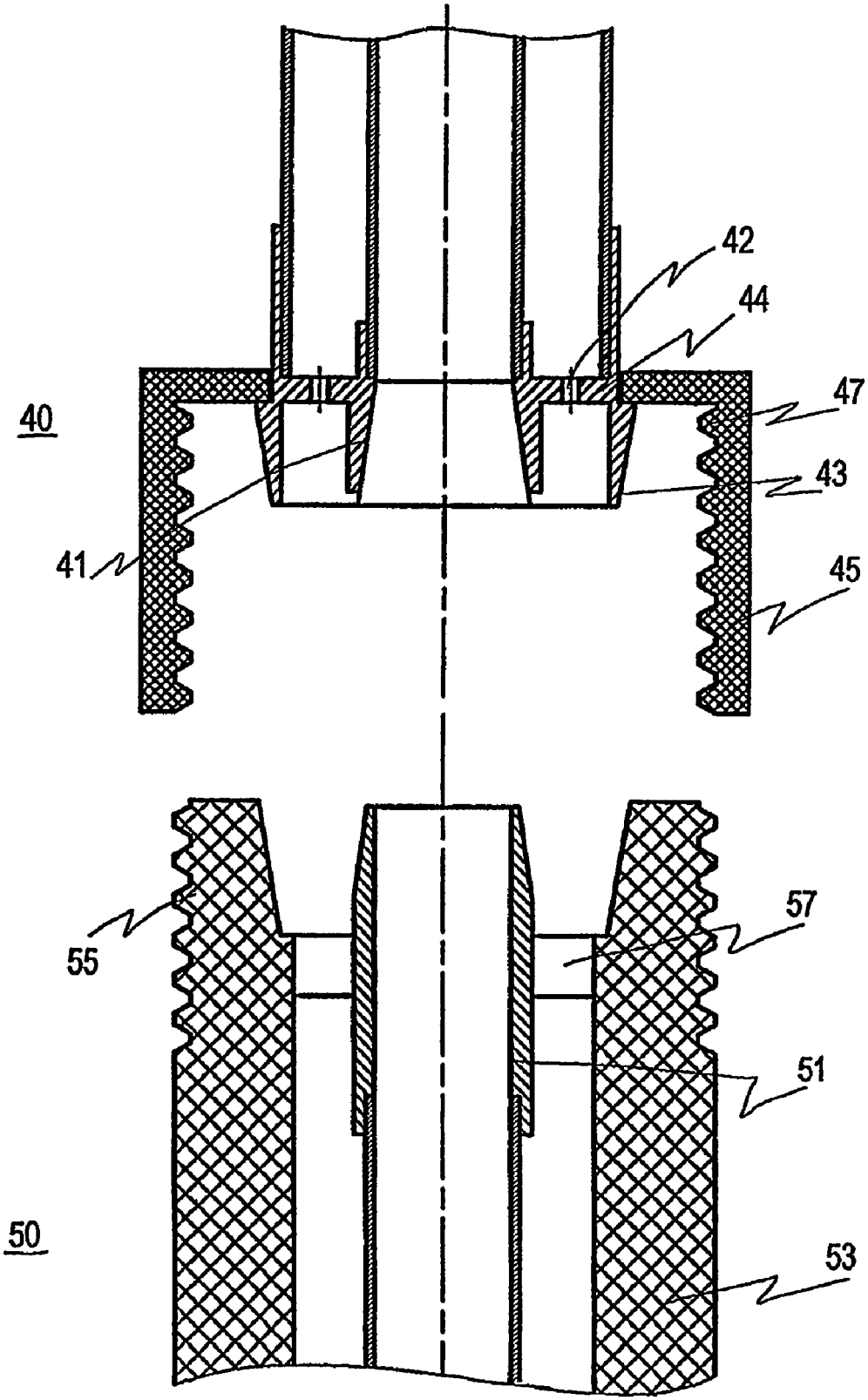
Figure 19:
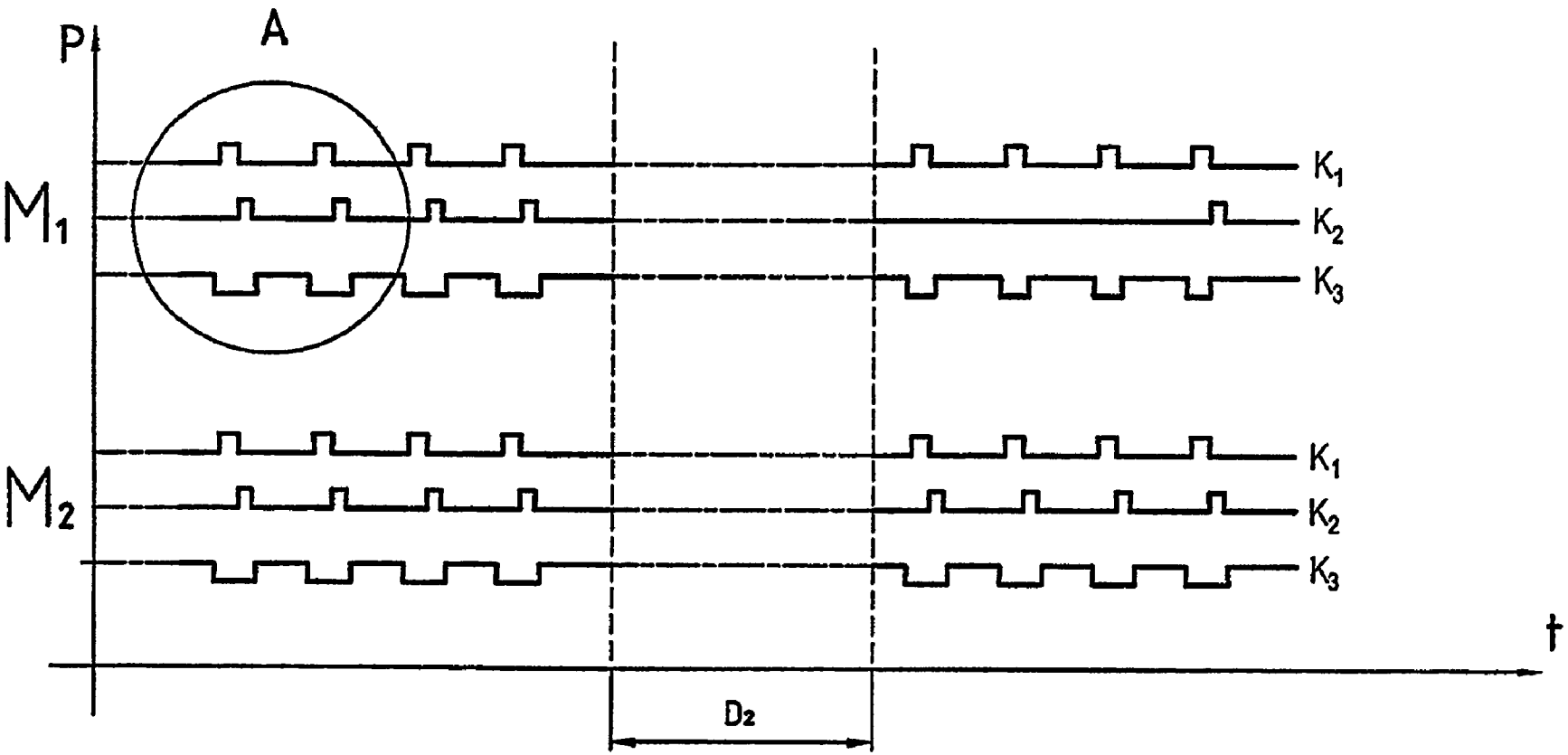
Figure 20:
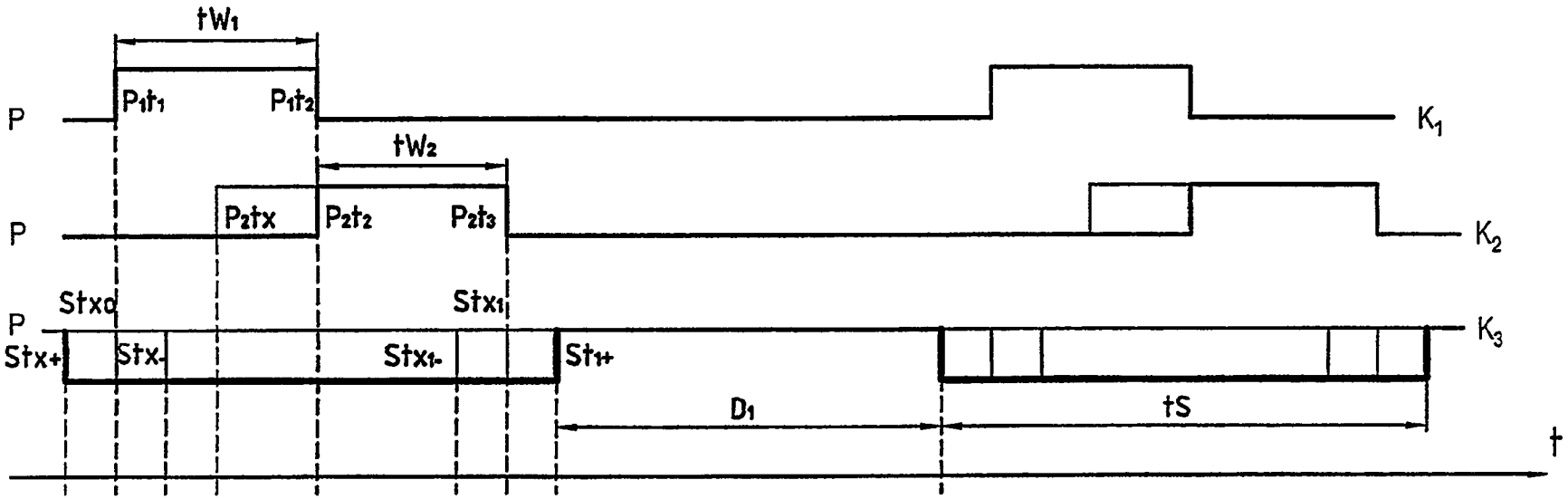
Figure 21:
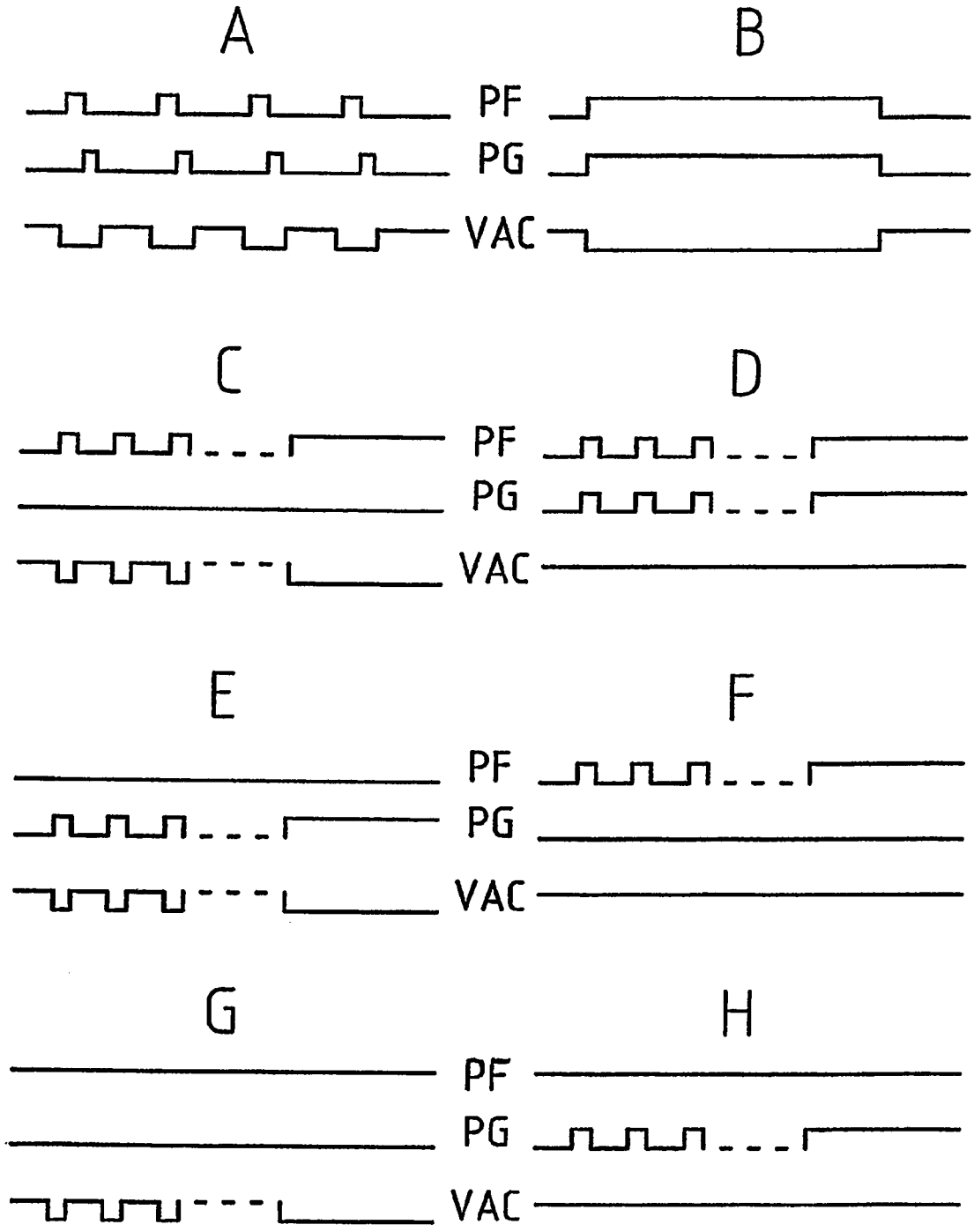

FIGS. 15(*a*), 15(*b*) and 15(*c*) are possible cross-sectional views of the delivery device from FIG. 14;

FIG. 16 is a top view of another embodiment of a delivery device which is equal to the delivery device shown in FIG. 14 except for the shape;

FIGS. 17(*a*), 17(*b*) and 17(*c*) are possible cross-sectional views of the delivery device from FIG. 16;

FIG. 18 is a longitudinal sectional view of a device for connecting a dual-passage tube;

FIG. 19 is a diagram for illustrating a pump control according to an embodiment;

FIG. 20 is an enlarged representation of the cut-out denoted with "A" from FIG. 19;

FIG. 21 shows diagrams for illustrating different types of the pump control.

Figure 1:
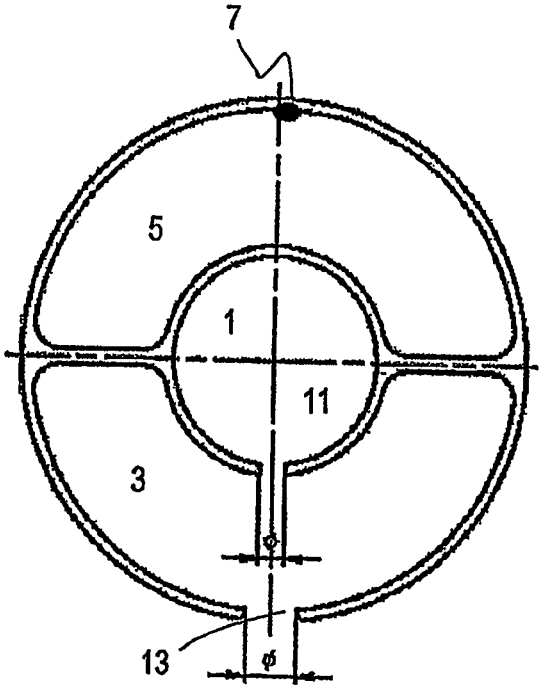
Figure 1:
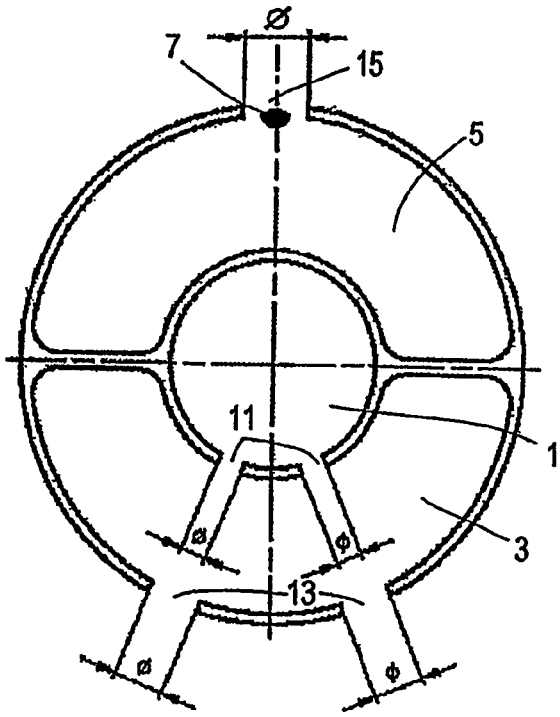
Figure 1:
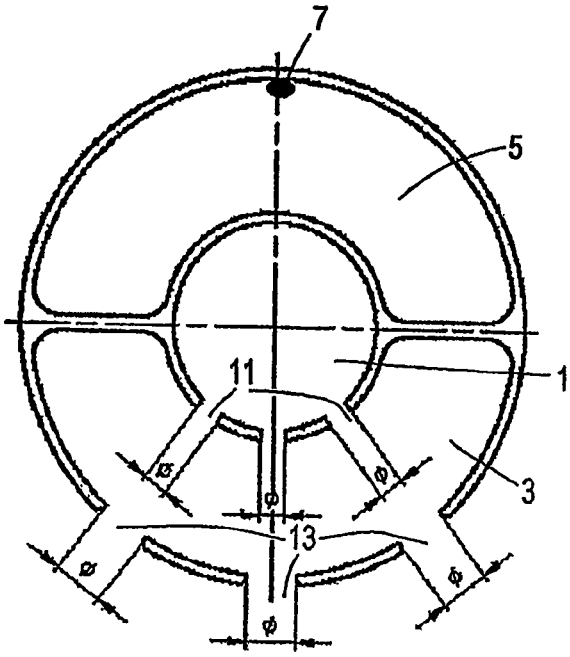
Figure 1:
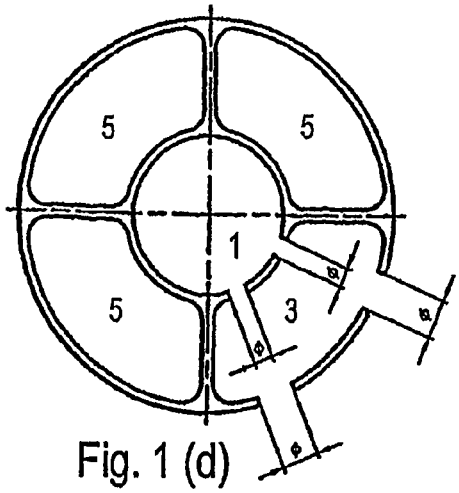
Figure 1:
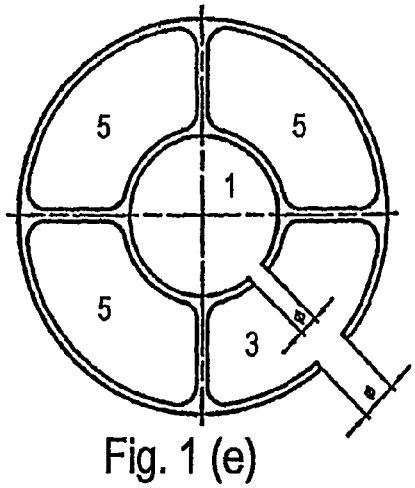
Figure 1:
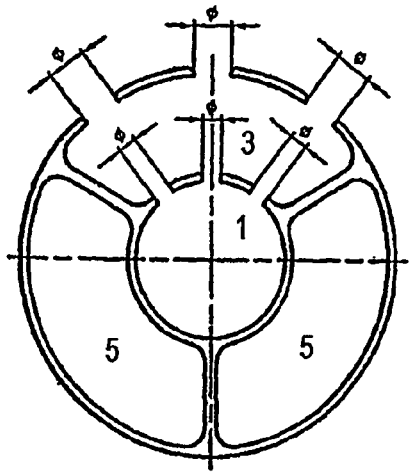
Figure 1:
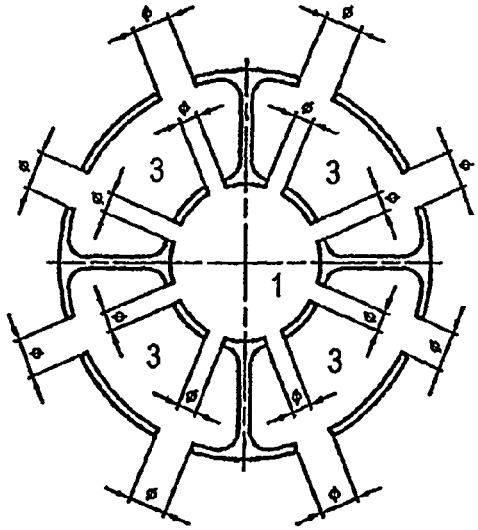
Figure 1:
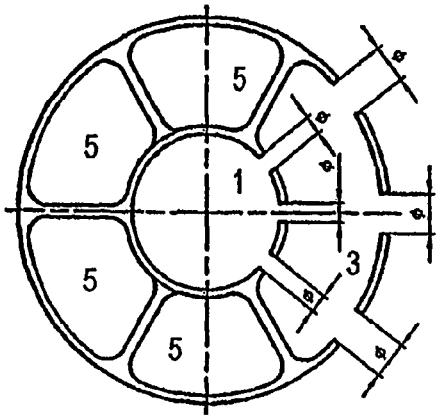
Figure 1:
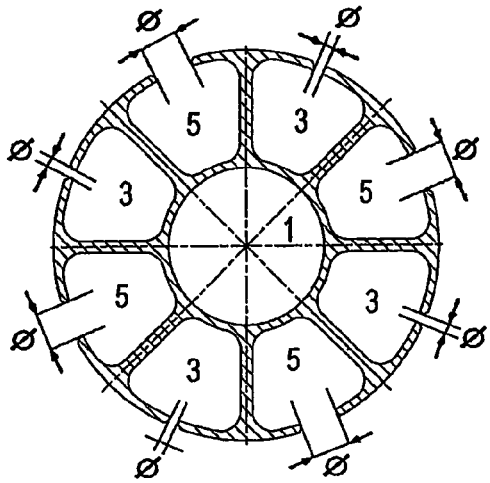

FIG. 1(*a*) to 1(*i*) are enlarged cross-sectional views of a tube serving as supply device or a delivery head formed in an end portion of the tube and serving as delivery device, hereinafter the cross-section shown in FIG. 1(*a*) and FIG. 1(*b*) being described as example.

Inside the tube three chambers extending coaxially into each other are formed, wherein a first chamber 1 is surrounded by a second chamber 3 and a third chamber 5. In the delivery head a liquid is injected through injection ports 11 provided in the wall between the first chamber 1 and the second chamber 3 from the first chamber 1 into a gas provided in the second chamber 3. The fluid mixture formed is then discharged from the second chamber 3 to the outside through delivery ports 13 provided in the outer wall of the chamber 3. The delivery ports 13 have a larger diameter than the injection ports 11. By the immediate discharge under pressure to the outside the fluid mixture is converted into mist.

The injection ports 11 and delivery ports 13 are formed to be aligned and can be arranged at freely selectable angles with respect to each other, as can be taken from FIG. 1(*b*), for instance. In this way the mist can be discharged in an angular range corresponding to the angle covered by the injection ports and delivery ports, respectively.

FIG. 1(*b*) exhibits, in addition to the three chambers 1, 3, 5 and the injection and delivery ports 11, 13, a suction port 15 through which a fluid mixture is sucked in and is sucked away from the delivery head through the third chamber 5 of the tube opposed to the general supply direction. The supply of the fluids to the delivery head and the suction from the delivery head, resp., is performed by a pump controlled by a digital control unit and will hereinafter be explained in detail.

A steel wire 7 provided in the third chamber 5 serves as reinforcement for the tube and/or the delivery head. It is especially also possible owing to the steel wire 7 to impart a predetermined shape to the tube and/or the delivery head. The imparted shape is then maintained by a plastic deformation of the steel wire 7.

Different examples of arranging spraying angles and chambers are moreover visible from the FIGS. 1(*c*) to 1(*i*) in which equal elements are denoted with the same reference numerals, as in FIGS. 1(*a*) and 1(*b*).

For reasons of clarity the injection and delivery ports are not marked by reference numerals in the FIGS. 1(*b*) to 1(*i*).

FIG. 1(*i*) shows an embodiment of a delivery head including alternately arranged chambers 3 for fluid supply and chambers 5 for sucking off the fluid or fluid mixture. The diameters of the delivery ports formed in the outer wall of the chamber 3 are smaller than those of the suction ports formed in the respective outer wall of the chambers 5. In the embodiment from FIG. 1(*i*) fluid is supplied merely through the outer chambers 3.

In all embodiments shown in FIGS. 1(*a*) to 1(*i*) it is also possible to supply different fluids to the individual chambers 3.

Figure 2:
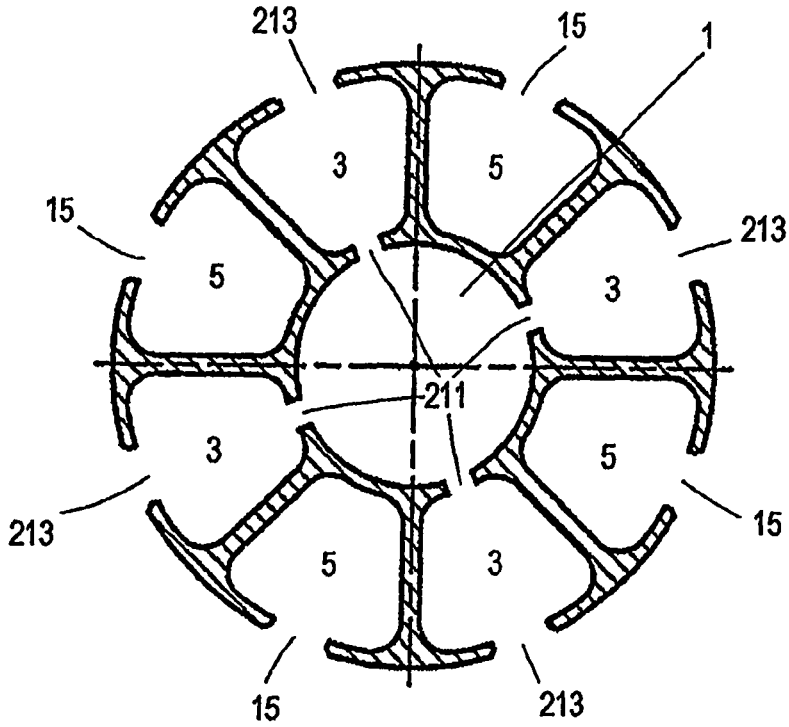
FIG. 2 is a cross-sectional view of a supply device according to the invention in the area of an end portion in the form of a delivery device according to a further embodiment.
Figure 3:
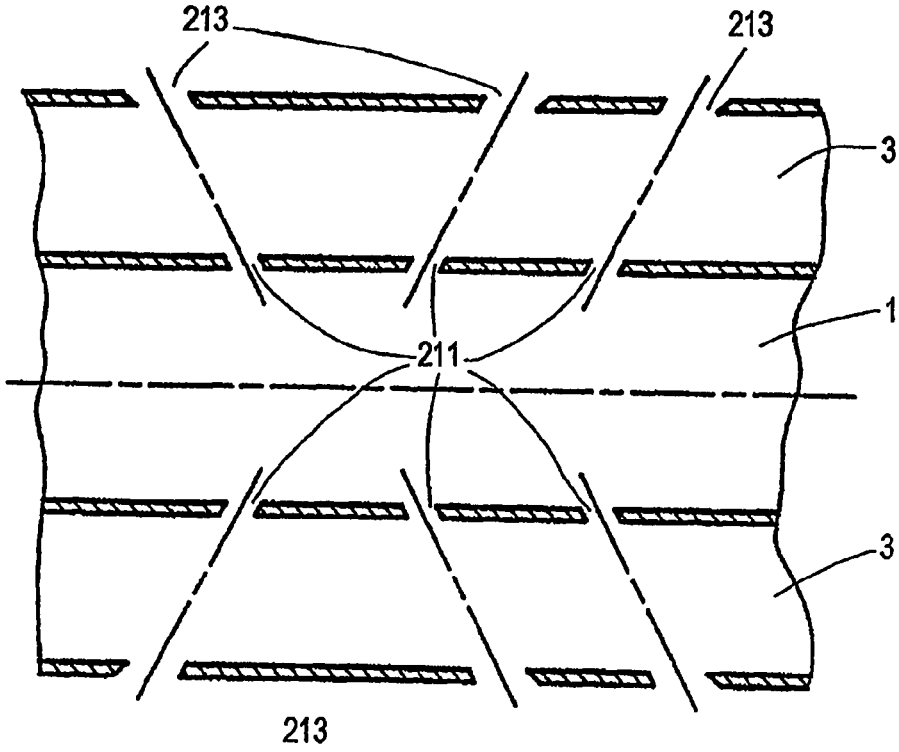
FIG. 3 is a longitudinal view of a portion of the supply device from FIG. 2.
Figure 4:
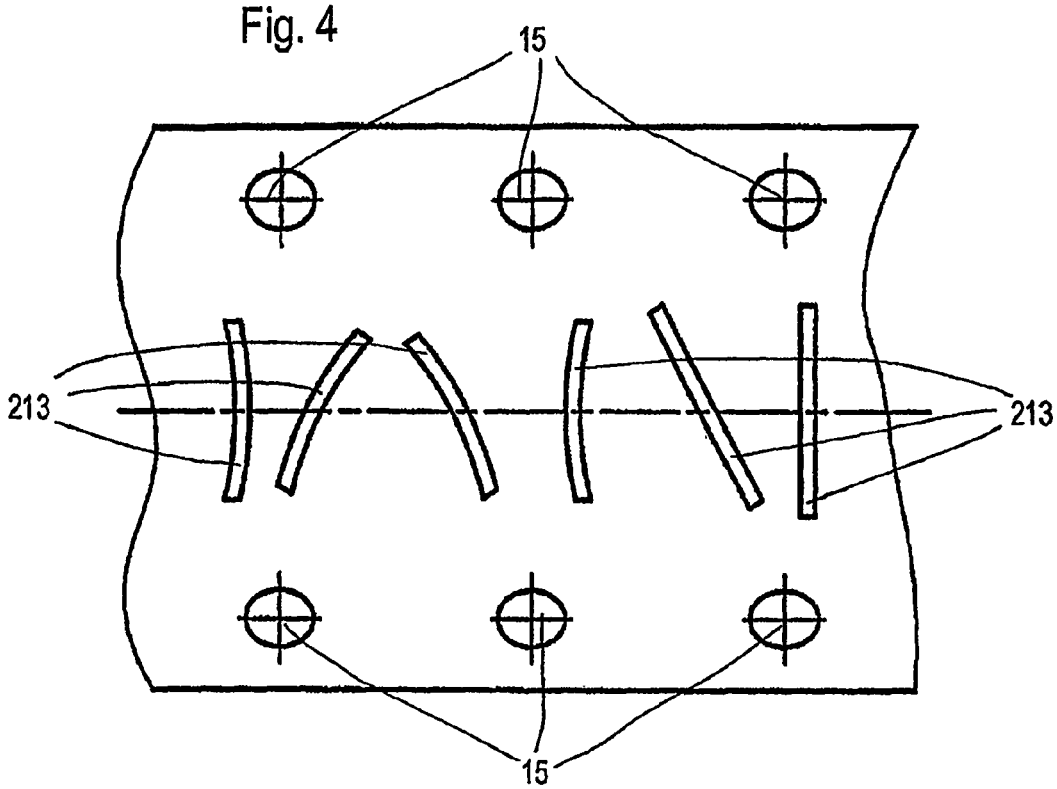
FIG. 4 is a top view of a portion of the supply device from FIG. 2.

FIGS. 2 to 4 show a part of a supply device in the form of a delivery head in accordance with a second embodiment of the invention. The substantial difference from the first embodiment consists in the fact that the central axes of the injection ports 211 and the delivery ports 213 are not located in a plane at right angles with respect to the central axis of the delivery head but are arranged inclined with respect thereto.

One can take from FIG. 3 that the respective central axes of the injection and delivery ports 211, 213 are disposed to be aligned.

As one can infer from FIG. 4, the cross-sections of the ports 211, 213 are in the form of ring segments and/or of rectangular slits.

Figure 5:
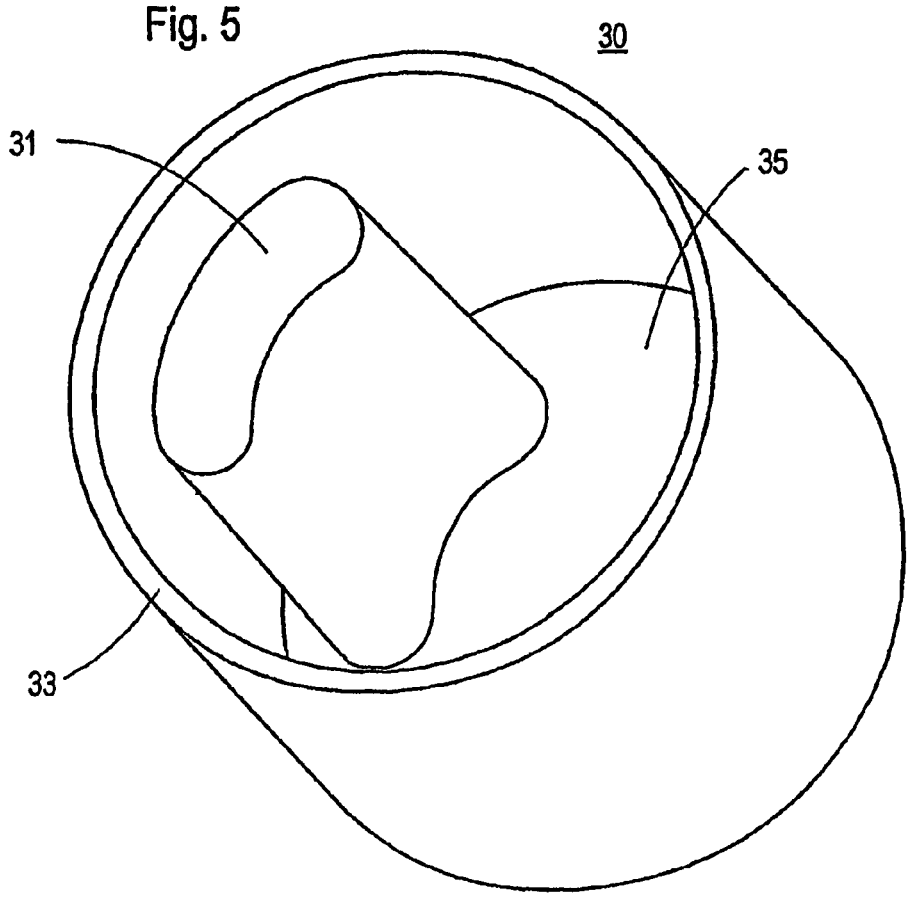
FIG. 5 is a three-dimensional view of a stopper element in the form of a plug according to the invention from the side facing a supply line.
Figure 6:
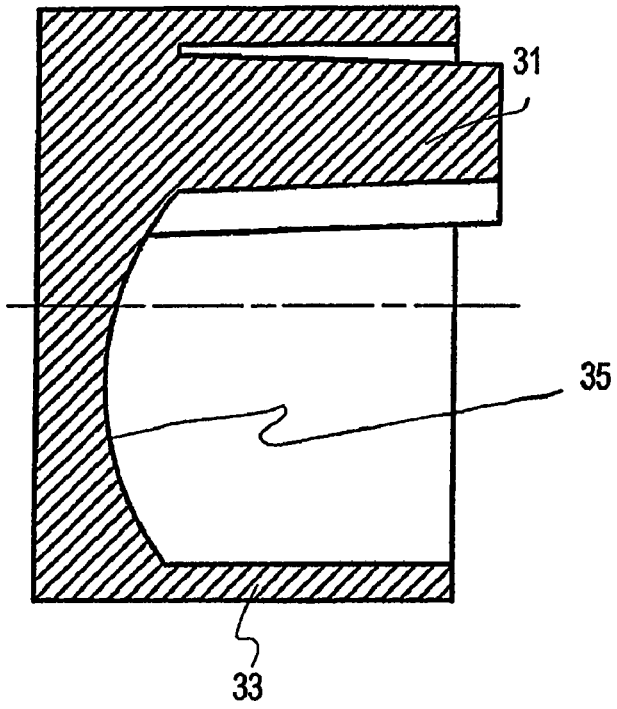
FIG. 6 is a sectional view of the plug from FIG. 5.
Figure 7:
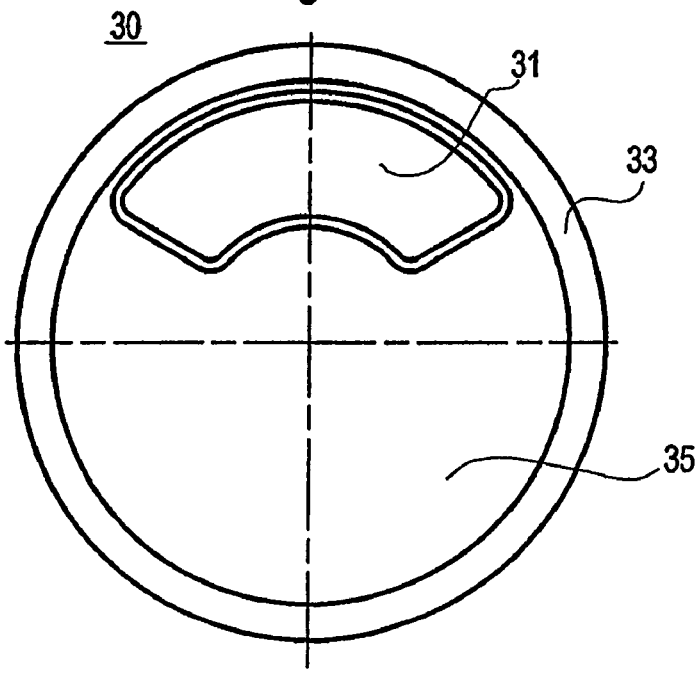
FIG. 7 is a top view of the plug from FIG. 5 from the side facing the supply line.
Figure 8:
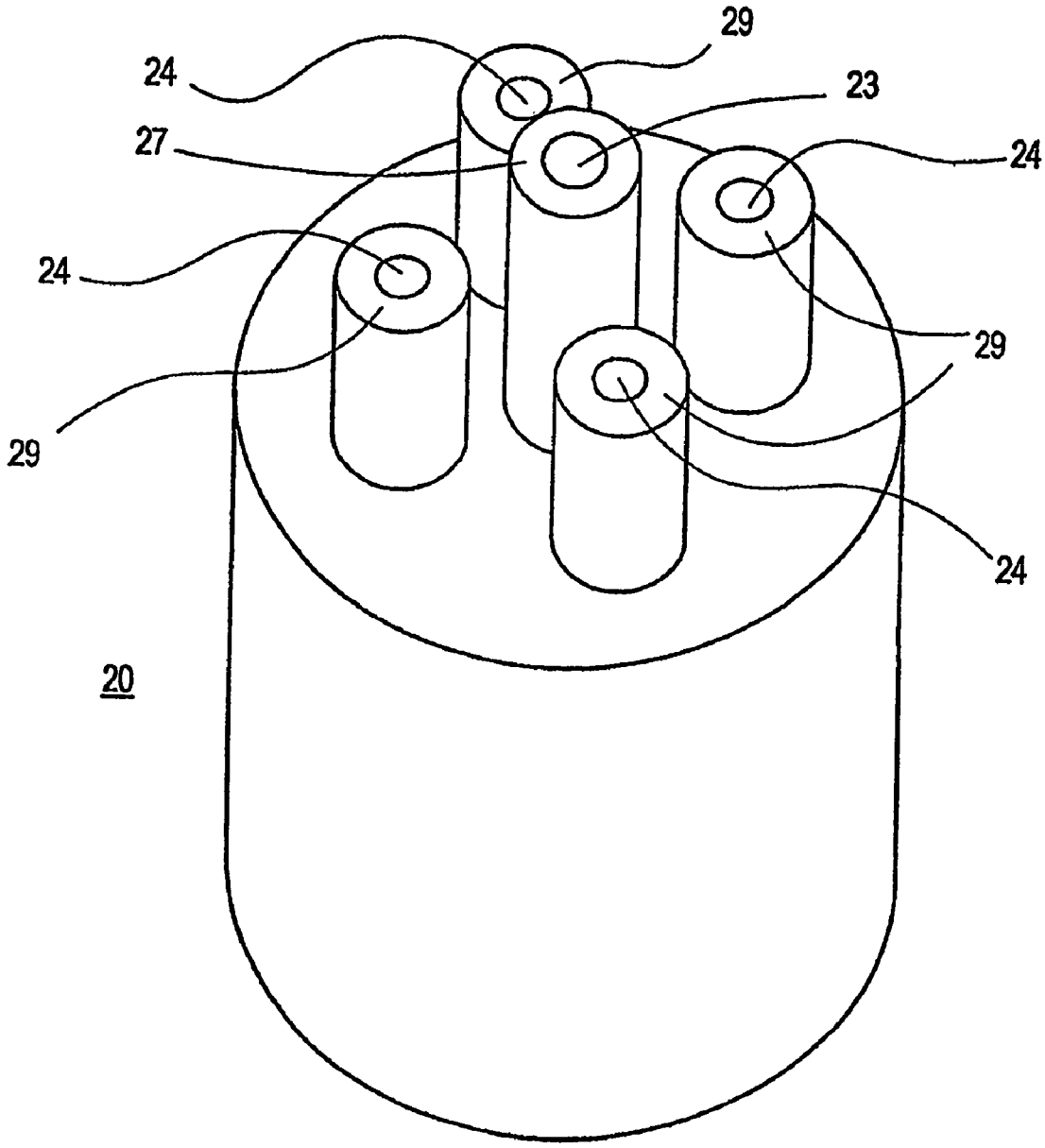
FIG. 8 is a three-dimensional view of a connecting member in the form of a connecting plug according to an embodiment of the invention from the side facing away from the supply line.
Figure 9:
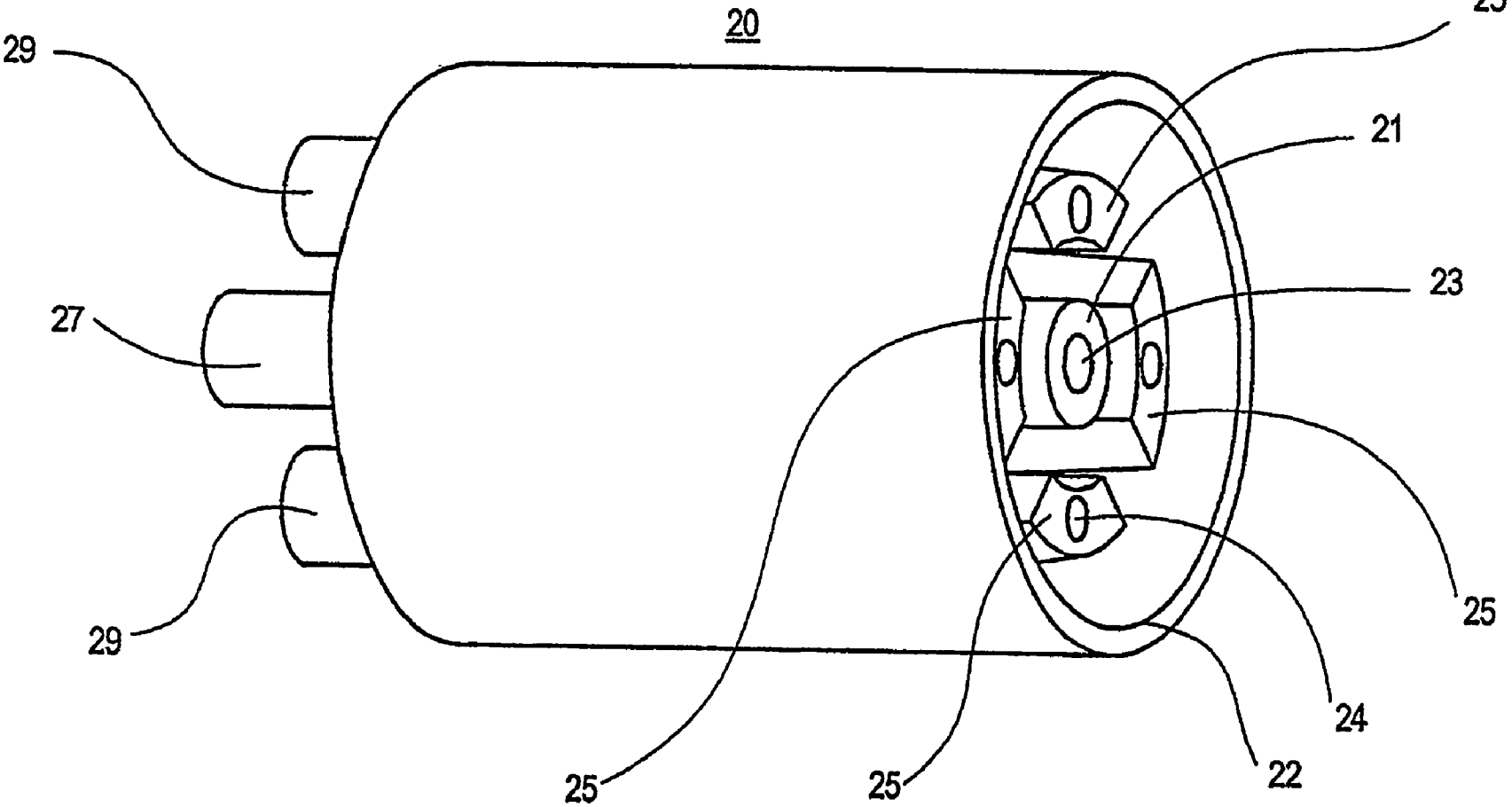
FIG. 9 is a three-dimensional view of the connecting member of FIG. 8 from the side facing the supply line.
Figure 10:
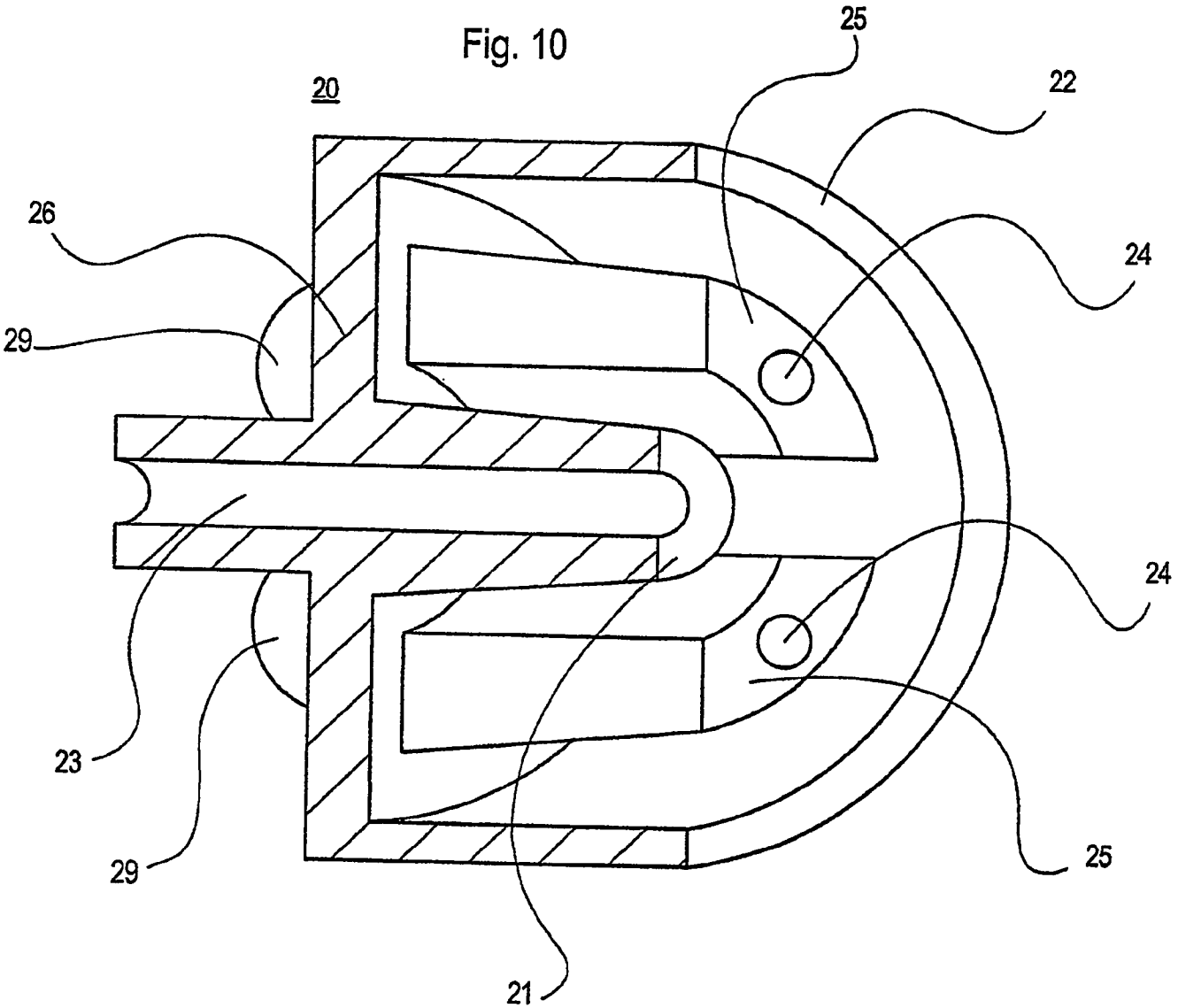
FIG. 10 shows a three-dimensional view cut along a symmetry plane of the connecting member of FIG. 8 from the side facing the supply line.
Figure 11:
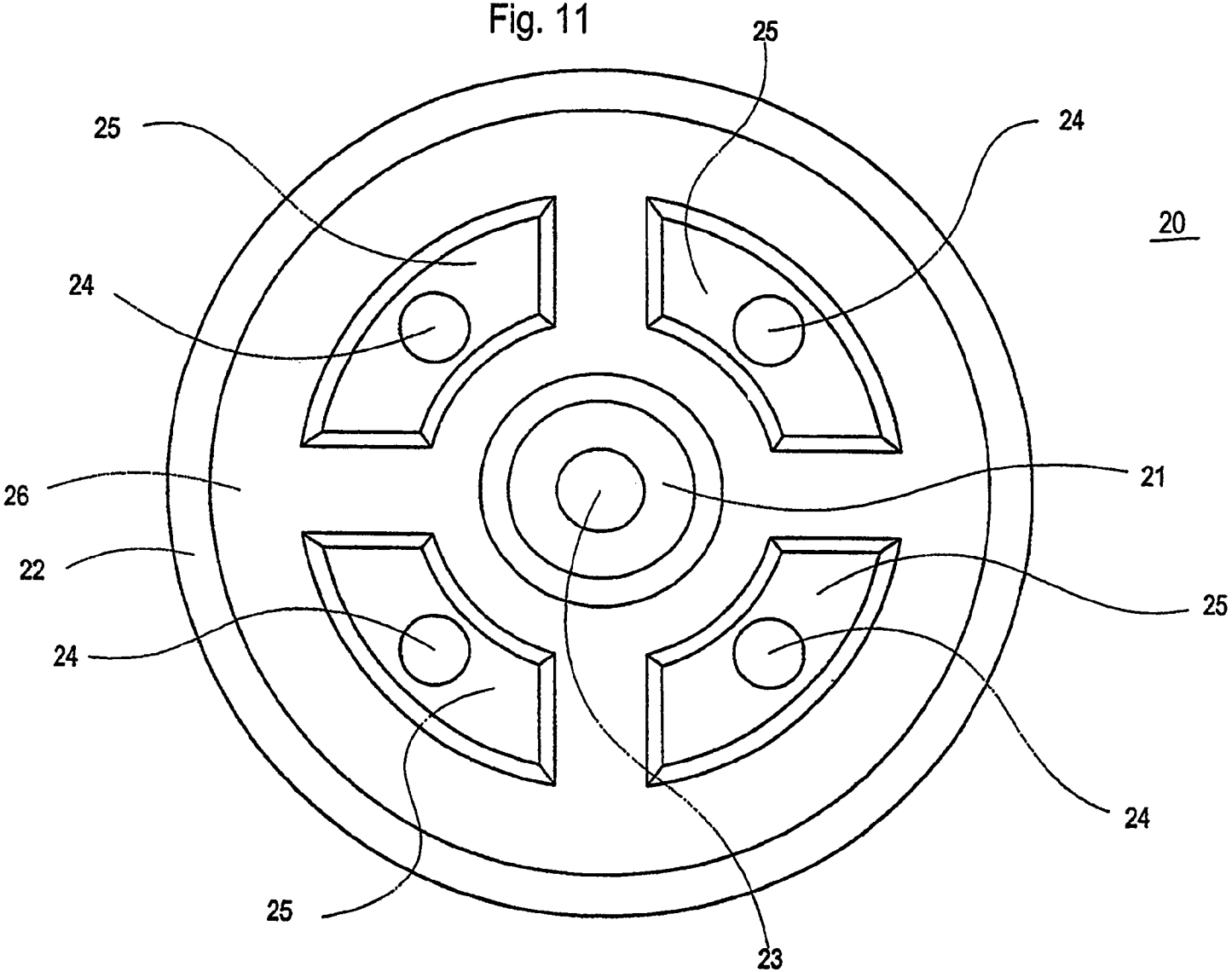
FIG. 11 shows a top view of the connecting member of FIG. 8 from the side facing the supply line.

FIGS. 5 to 7 show various views of a sealing member in the form of a plug 30. The plug 30 shown in the three-dimensional view of FIG. 5 is provided for a delivery device having the cross-section shown in FIG. 1(*f*) or FIG. 1(*h*). The plug 30 consists of a cylindrical shell 33 including a concave bottom 35 and a projection 31 protruding from the bottom. The inner diameter of the shell 33 corresponds to the outer diameter of the tube and is flush with the same in a fluid-tight manner.

The projection 31 is tapered from the bottom. By applying the plug 30 to the tube the projection 31 is introduced into the chamber 3 so as to seal the chamber 3 against the chambers 1 and 5 in a fluid-tight manner such that a connection exists merely via the injection ports 11.

As one can take from the sectional view of FIG. 6, a space is remaining between the bottom 35 and the open end of the tube, because the bottom 35 of the plug 30 has a concave shape. For this reason, there is a fluid connection between the chambers 1 and 5.

FIG. 7 is a top view of the plug from FIG. 6 which is provided, for instance, for a supply line having the cross-sections shown in FIG. 1(*f*) or FIG. 1(*h*).

FIGS. 8 to 11 exhibit a connecting plug 20 formed as connecting member which is disposed at the end of the supply line opposed to the delivery device. The connecting plug shown in FIGS. 8 to 11 is likewise provided for a supply line having the cross-sectional geometry shown in FIGS. 1(*d*) and 1(*e*).

The plug 20 equally includes a cylindrical wall 22 and a bottom 24. On a side facing away from the supply line (outside) a connecting nozzle 27 and a plurality of connecting nozzles 29 protrude from the bottom. Pipes for fluids which are not shown are connected to the connecting nozzles 27, 29.

A projection 21 protruding from the bottom on a side facing the supply line (inside) is associated with the one connecting nozzle 27 and a plurality of projections 25 protruding from the bottom on the inside are associated with respective connecting nozzles 29. Through each connecting nozzle 27, 29, the bottom and the respectively associated projection 21, 25 conduits 23, 24 in the form of breakthroughs are formed. The projections 21, 25 are tapered in the direction of the inside and serve as coupling element according to the invention.

After arranging the connecting plug 20 at the one end of the supply line, the projection 21 is introduced into the chamber 1 and the projections 25 are introduced into the chamber 3 and/or the chambers 5. Thus, the end of the supply line is sealed against the environment in such manner that fluids can be supplied or discharged only through the conduits 23, 24 into the individual chambers 1, 3, 5, as one can take from the cut view of FIG. 10 and from FIG. 11.

Figure 12:
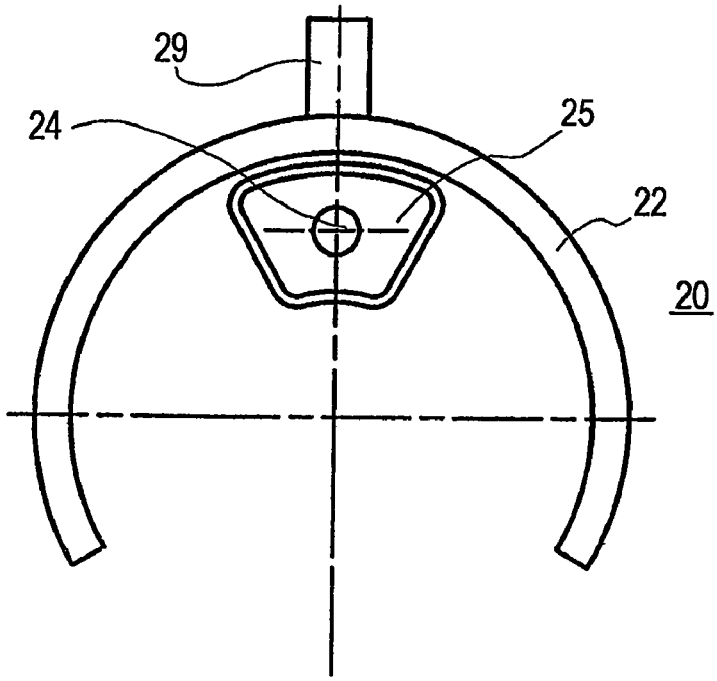
FIG. 12 is a top view of a connecting member in the form of a connecting plug according to another embodiment of the invention.
Figure 13:
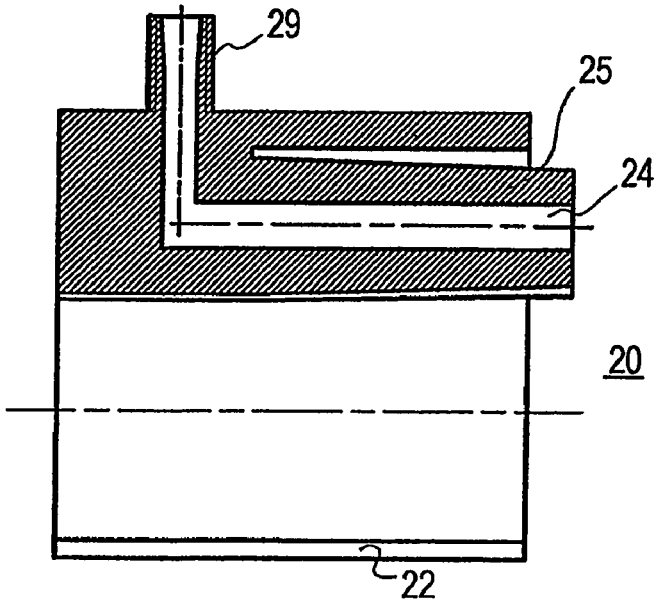
FIG. 13 is a cut view of the connecting plug of FIG. 12.

FIGS. 12 and 13 exhibit a top view and a sectional view, respectively, of another embodiment for a connecting plug 20. Said connecting plug 20 includes a connecting nozzle 29 which is substantially located at right angles with respect to the central axis of the supply system. According to the shown embodiment, a projection 25 for introduction into a chamber 3 of a supply device according to the invention is provided, and a fluid is introduced into the chamber 3 through the conduit 24.

FIGS. 14, 15(*a-c*), 16 and 17(*a-c*) show another embodiment of delivery heads for different mediums, which are identical from the top view except for the shape. The delivery head includes two connections 105, 107, a first chamber 101 and there beneath a second chamber 103. A liquid is supplied into the first chamber 101 via the first connection 105, whereas a gas is directly supplied into the second chamber 103 via the second connection 107.

In the entire area of an inner wall between the first chamber 101 and the second chamber 103 likewise a plurality of injection ports 111 are formed, whereas in an outer wall of the second chamber delivery ports 113 corresponding to the injection ports 103 are provided. Said delivery ports 113 also have a larger diameter than the injection ports 101. It is possible by a particular arch of the outer wall and, in parallel thereto, of the inner wall to clearly define an angular range which is exposed to a mist formed and discharged by the delivery head. FIGS. 15(*a-c*) and 17(*a-c*) show exemplary configurations of concavely and convexly arched walls as well as of plane walls.

FIG. 18 illustrates a connecting device for a fluid-tight connection of a tube with two chambers.

In a connecting member 40 an internal pipe element 41 and an external pipe element 43 are connected by a flange portion 42 provided with holes 44. Outside the external pipe element 43 a sleeve member 45 is provided as securing element. Projections 47 are formed on the inner surface of the sleeve member 45.

A nozzle member 50 of the connecting device likewise includes an internal pipe element 51 and an external pipe element 53 which are interconnected by means of positioning members 57. A portion on the outside of the nozzle member 50 is provided with recesses 55, the projections 47 of the sleeve member 45 being engaged with said recesses when a fluid-tight connection has been brought about.

The inner end faces of the pipe elements 41, 53 and the outer end faces of the pipe elements 43, 51 are conical. In this way it is possible by simply plugging the respective pipe elements into each other to make a fluid-tight connection which is protected against unintended release by the sleeve member.

FIGS. 19 and 20 are a diagram and a cutout from the diagram, resp., for illustrating the function of a digital control unit in accordance with an embodiment which can be combined with a supply system according to the invention. In FIG. 19, M1 and M2 denote two different exemplary possibilities (modules) for controlling the fluid supply of a supply system including three chambers 1, 3, 5, as it is shown in FIG. 1(*b*), for instance. "A" denotes a detailed cutout of the diagram marked by a circle A which is shown enlarged in FIG. 20.

The curve denoted with K1 represents the pressure pattern controlled by the control unit in the first chamber 1 through which a liquid is supplied. In accordance with the diagram, the pressure P is increased in the first chamber 1 at a time $t_1$ to a value $P_1$ and is kept at said value until a time $t_2$. At the same time $t_2$ the pressure P is increased in the second chamber to a value $P_2$ so as to be reduced again upon reaching a time $t_3$. At a time $t_{x0}$ the pressure is reduced in the third chamber so that a vacuum S is formed. The latter is kept until a time $t_{x1}$ so as to be increased to P again.

It is permitted by this control to discharge or suck in the respective fluids at particular times from the individual chambers. Both the times and the pressures can be freely adjusted in accordance with the respective requirements. For instance, the time intervals of the second chamber and the third chamber can be modified for the second pump to the time denoted with $t_x$ and/or for the suction pump to the time denoted with $t_{x+}$ or $t_{x-}$.

A complete list of the symbols used in FIGS. 19 and 20 is as follows:

| | |
|---|---|
| $M_1$ | module 1 |
| $M_2$ | module 2 |
| $tW_1$ | operating time pump 1 |
| $tW_2$ | operating time pump 2 |
| $t_1$ | starting time pump 1 |
| $t_2$ | finishing time pump 1 |
| $t_2$ | starting time pump 2 |
| $t_3$ | finishing time pump 2 |
| $t_x$ | Possible postponement of the starting time of pump 2 |
| $t_s$ | operating time suction pump |
| $t_{x0}$ | starting time suction pump |
| $t_{x1}$ | finishing time suction pump |
| $St_{x+}$, $St_{x-}$, $St_{x1+}$, $St_{x1-}$ | Possible postponement of the starting/finishing time of the suction pump |
| $D_1$ | delay |
| $D_2$ | delay between cycles |
| P | starting pressure |
| $P_1$ | pressure increase pump 1 |
| $P_2$ | pressure increase pump 2 |
| S | pressure reduction suction pump |
| $K_1$ | chamber 1 |
| $K_2$ | chamber 2 |
| $K_3$ | chamber 3 |

It can moreover be inferred from the diagram that it is also possible to provide individual delivery cycles which are separated by a time interval D2 in which the pump is not operating. Within the individual delivery cycles it is likewise possible to provide a delay interval D1 between the individual pressure variations. The time intervals D1 and D2 are freely adjustable for each cycle and D1 can also be varied within one cycle.

Furthermore, the digital control unit permits the use of plural independent control passages. By each passage different devices, such as e.g. roller pumps, vacuum pumps, pneumatic pumps, supply devices operating according to the ink jet principle, electromechanical air valves (compressed air, vacuum), electric relays or electric apparatuses (suction means, pumps etc.), can be controlled. The different devices can be combined with each other, additionally connected or used as an alternative according to needs.

Respective sensors which detect the pressures prevailing in the chambers are provided for the individual chambers. A control unit is capable of comparing the detected pressures to the predetermined desired pressures and to adapt them in the case of deviation.

FIG. 21 shows schematic diagrams to illustrate different examples of possible controls that can be performed by means of the control apparatus. In FIG. 21 the time axis is left aside. In the respective diagrams A to H the topmost axis corresponds to the pressure generated by a first pressure pump for a fluid such as, e.g., a liquid, which is higher than the starting pressure P and is generated at the time intervals visible from the respective diagram in a first chamber of a supply system according to the invention. The central axis in the diagrams A to H corresponds to the pressure generated by a second hydraulic pump for a fluid such as e.g. a gas, which is equally higher than the starting pressure P and which is generated at the time intervals visible from the respective diagram in a second chamber of a supply system according to the invention. The respective lowermost axis of the diagrams A to H corresponds to a vacuum generated in a third chamber by a vacuum pump at the predetermined time intervals.

The diagram of FIG. 21 denoted with A substantially corresponds to the cutout A from FIG. 19 shown enlarged in FIG. 20. According to the diagram A, both hydraulic pumps are operated to generate pressure in the respective chambers at the predetermined intervals. Moreover a vacuum pump for generating a vacuum in the third chamber is connected in the predetermined intervals.

The diagram of FIG. 21 denoted with B shows the operation of two hydraulic pumps connected to each other and to a vacuum pump which are operated in the same interval.

As one can take from the diagrams of FIG. 21 denoted with C to H, it is advantageously also possible by means of the control apparatus to disconnect individual pumps. In the diagrams C merely the operation of the first hydraulic pump for a liquid together with a vacuum pump for generating a vacuum is shown. According to the diagram D, only the two hydraulic pumps for liquid and gas are operated, while the vacuum pump is not connected. The diagram E shows the operation of the second hydraulic pump for gas which is interconnected with the vacuum pump. The diagrams F to H show the operation of merely one pump. In the diagram F this is the first hydraulic pump, in the diagram G it is the second hydraulic pump and in the diagram H it is the vacuum pump.

The control apparatus permits to switch on and off the respective devices within a time interval from 1 s to 24 h, wherein breaks of 1 s to 23 h 59 min 59 s are possible between the individual cycles.

The control apparatus can be programmed directly or flexibly via a PC.

The invention claimed is:

1. A supply device for fluids, comprising a fluid supply line consisting of a first chamber for supplying a first fluid and a second chamber for supplying a second fluid, and an end member for supplying a fluid mixture to a surface exposed to the fluid mixture including the first chamber with the first fluid and the second chamber with the second fluid, wherein a plurality of injection ports for delivering the first fluid into the second chamber are provided between the first and second chambers, wherein delivery ports are provided between the second chamber and an exterior of the supply device, wherein the first and second chambers are flat-shaped in an area of the end member, wherein the second chamber is adjacent to the first chamber in the form of layers, wherein one end of the fluid supply line is configured to be closed by a sealing member comprising a plug having a cylindrical shell including a concave bottom and a projection protruding from the bottom, and wherein an inner diameter of the shell corresponds to an outer diameter of the supply line, wherein the first chamber and the second chamber are formed coaxially by axial division of the fluid supply line, and wherein between a third chamber and the exterior of the supply device a plurality of suction ports are provided to suck in a fluid mixture through the third chamber and to discharge the fluid mixture in a direction opposed to a feeding direction of the fluid mixture.

2. The supply device according to claim 1, wherein a cross-section of the first chamber has a shape of a circle, and wherein a cross-section of the second chamber has a shape of a ring segment.

3. The supply device according to claim 1, wherein one end of the supply line is provided with a nozzle member to supply the first and second fluids through the nozzle member into the first and second chambers, respectively.

4. The supply device according to claim 3, wherein the nozzle member includes external pipe nozzles for the connection of external feed lines and includes internal coupling members adapted to be introduced into the respective chambers in a tight-fitting manner, wherein the respective fluid is supplied through a passage guided through the respective pipe nozzle, a bottom and the respective coupling member into the corresponding chamber.

5. The supply device according to claim 1, wherein the injection ports are smaller than the delivery ports.

6. The supply device according to claim 1, wherein the injection ports and the delivery ports are designed to be substantially radially aligned.

7. The supply device according to claim 1, wherein central axes of the injection ports and the delivery ports are located at an angle of from 0° to 90° with respect to a central axis of the supply device, and wherein a respective injection port is formed to be aligned with a respective delivery port.

8. The supply device according to claim 1, wherein a cross-section of the injection ports and the delivery ports is circular or rectangular or oval or elliptical or formed as segment of a circle or as ring segment or star-shaped.

9. The supply device according to claim 1, wherein an internal projection of the sealing member seals a chamber against the first and third chambers, whereas the first and third chambers are connected via a cavity of the sealing member such that a fluid can flow from the third chamber into the first chamber.

10. The supply device according to claim 1, wherein the chambers are sealed against each other by the sealing member, wherein between a third chamber and a first chamber a connection adapted to be closed by a valve is brought about so that the fluid can flow from the third chamber into the first chamber.

11. A method of supplying a fluid mixture to a surface, the method comprising:

injecting at least one of a first fluid and a third fluid from a first flat-shaped chamber via a plurality of injection ports into a second fluid in a second flat-shaped chamber which is adjacent to the first chamber in the form of layers, pressurizing the fluids individually in the chambers over predetermined time intervals so as to form a predetermined fluid mixture in the second chamber, discharging the fluid mixture formed to an exterior of the second chamber via a plurality of delivery ports, and generating a vacuum in a third chamber in order to suck off a fluid mixture via the third chamber.

12. A method of supplying a fluid mixture to a surface, the method comprising:

injecting at least one of a first fluid and a third fluid from a first flat-shaped chamber via a plurality of injection ports into a second fluid in a second flat-shaped chamber which is adjacent to the first chamber in the form of layers, pressurizing the fluids individually in the chambers over predetermined time intervals so as to form a predetermined fluid mixture in the second chamber, and discharging the fluid mixture formed to an exterior of the second chamber via a plurality of delivery ports, wherein injecting at least one of a first fluid and a third fluid includes injecting the third fluid into the second chamber from the first chamber and flowing the third fluid into the first chamber from a third chamber.

13. The method according to claim 12, wherein the first fluid is a liquid and the second fluid is a gas.

14. The method according to claim 13, wherein the liquid is injected into the gas such that mist is formed.

* * * * *